US006446429B2

(12) United States Patent
Kobayashi et al.

(10) Patent No.: US 6,446,429 B2
(45) Date of Patent: Sep. 10, 2002

(54) AIR-FUEL RATIO CONTROL OF ENGINE

(75) Inventors: Hideaki Kobayashi, Yokohama; Osamu Matsuno, Ayase; Masatomo Kakuyama, Yokohama, all of (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 09/790,901

(22) Filed: Feb. 23, 2001

(30) Foreign Application Priority Data

Feb. 23, 2000 (JP) ..... 2000-046102

(51) Int. Cl.[7] ..... F01N 3/00

(52) U.S. Cl. ..... 60/285; 60/274; 60/276; 60/277; 123/688

(58) Field of Search ..... 60/274, 276, 277, 60/285; 123/688, 679

(56) References Cited

U.S. PATENT DOCUMENTS

| | | | | |
|---|---|---|---|---|
| 4,638,658 A | * | 1/1987 | Otobe | 123/688 |
| 5,154,055 A | * | 10/1992 | Nakane et al. | 60/277 |
| 5,337,558 A | * | 8/1994 | Komatsu | 60/277 |
| 5,475,975 A | * | 12/1995 | Nasu | 60/276 |
| 5,485,826 A | * | 1/1996 | Ohata et al. | 123/679 |
| 5,568,725 A | * | 10/1996 | Uchikawa | 123/688 |
| 5,602,737 A | * | 2/1997 | Sindano et al. | 60/277 |
| 5,842,340 A | | 12/1998 | Bush et al. | 60/274 |
| 5,845,489 A | * | 12/1998 | Dohta et al. | 60/277 |

FOREIGN PATENT DOCUMENTS

| | | |
|---|---|---|
| JP | 5-195842 | 8/1993 |
| JP | 7-259602 | 10/1995 |

OTHER PUBLICATIONS

U.S. patent application Ser. No. 09/418,255, Tayama et al., filed Oct. 15, 1999.

* cited by examiner

*Primary Examiner*—Thomas Denion
*Assistant Examiner*—Tu M. Nguyen
(74) *Attorney, Agent, or Firm*—Foley & Lardner

(57) ABSTRACT

A catalytic converter (3) having a three-way catalyst which stores oxygen is disposed in the exhaust passage (2) of an engine (1). An oxygen storage amount of the catalyst is estimated based on the output of a universal exhaust gas oxygen sensor (4) provided upstream of the catalytic converter (3). A control unit (6) controls an air-fuel ratio of the fuel mixture supplied to the engine (1) through a fuel injector (12) so that the oxygen storage amount coincides with a target value. An excess/deficiency oxygen amount in the exhaust gas is accumulated when the output of an oxygen sensor (5) which detects the oxygen concentration downstream of the catalytic converter (3) is in an excess oxygen region which is higher than a stoichiometric oxygen concentration region. An average oxygen excess ratio is calculated by dividing the accumulated value by an accumulated intake air amount. The output of the universal exhaust gas oxygen sensor (4) is corrected based on the average oxygen excess ratio. In the same manner, the output of the universal exhaust gas oxygen sensor (4) is corrected based on the average oxygen excess ratio when the output of the oxygen sensor (5) is in an deficiency oxygen region which is lower than the stoichiometric oxygen concentration region. These corrections compensate for fluctuations in the output resulting from deterioration of the universal exhaust gas oxygen sensor (4) or due to manufacturing errors and the calculation accuracy of the oxygen storage amount of the catalyst is thereby increased.

10 Claims, 8 Drawing Sheets

AIR-FUEL RATIO CONTROL OF ENGINE

FIELD OF THE INVENTION

This invention relates to correction of the output of a universal exhaust gas oxygen sensor which detects an oxygen concentration in exhaust gas of an internal combustion engine.

BACKGROUND OF THE INVENTION

In order to maximize the performance of a three-way catalyst which removes toxic components such as hydrocarbons (HC), carbon monoxide (CO) and nitrogen oxides (NOx) from engine exhaust gas, it is necessary to maintain an oxygen concentration of the gaseous environment of the catalyst equal to that of the burnt gas produced by the combustion of fuel mixture of a air-fuel ratio.

The catalyst has the function of storing and releasing oxygen in response to the oxygen concentration in a catalytic converter storing the catalyst such that the gaseous environment of the catalyst is maintained at an oxygen concentration corresponding to the stoichiometric air-fuel ratio.

In order to maximize the oxygen storage/release function of the catalyst, it is desirable that a target value for the catalyst oxygen storage amount is set to half the oxygen storage capacity of the catalyst and that the air-fuel ratio of the fuel mixture supplied to the engine is controlled to maintain the oxygen storage amount of the catalyst to the target value.

U.S. Pat. No. 5,842,340 discloses a calculating method of the oxygen storage amount of the catalyst. This method estimates the oxygen storage amount of the catalyst by analysis of an output signal of oxygen sensors provided upstream and downstream of the catalytic converter.

It also discloses control of the air-fuel ratio of the fuel mixture supplied to the engine so that the oxygen storage amount coincides with the target value.

A similar method is also disclosed in Tokkai Hei 5-195842 published by the Japanese Patent Office in 1993 and Tokkai Hei 7-259602 published by the Japanese Patent Office in 1995.

SUMMARY OF THE INVENTION

The above method uses a universal exhaust gas oxygen sensor which can detect a wide range of oxygen concentrations for the oxygen sensor provided upstream of the catalytic converter. The universal exhaust gas oxygen sensor has a tendency to deteriorate overtime due to exposure to high exhaust gas temperatures. Furthermore errors may result in detected oxygen concentrations due to quality control problems during manufacture of the sensor.

Such deterioration or manufacturing errors result in reductions in the calculation accuracy of the oxygen storage amount of the three-way catalyst that may result in a reduction of the exhaust gas purification performance of the catalyst.

It is therefore an object of this invention to correct fluctuations in the output of the universal exhaust gas oxygen sensor provided upstream of the catalyst due to the deterioration or manufacturing errors and to increase the calculation accuracy of the oxygen storage amount of the catalyst.

In order to achieve the above object, this invention provides an air-fuel ratio controller for such an engine that comprises an exhaust passage, a catalytic converter disposed in the exhaust passage to purify exhaust gas, the catalytic converter accommodating a catalyst which stores oxygen when an oxygen concentration in exhaust gas is higher than a predetermined concentration and releases oxygen when the oxygen concentration in exhaust gas is lower than the predetermined concentration, and a fuel injector which supplies fuel to the engine.

The controller comprises a first oxygen sensor which detects an oxygen concentration in the exhaust passage upstream of the catalytic converter and outputting a corresponding signal, a second oxygen sensor which detects an oxygen concentration in the exhaust passage downstream of the catalytic converter and outputting a corresponding signal, and a microprocessor.

The microprocessor is programmed to calculate a fuel injection amount of the fuel injector to cause an output signal of the first oxygen sensor to coincide with a value corresponding to the stoichiometric air-fuel ratio, calculate an oxygen storage amount of the catalyst based on the output signal of the first oxygen sensor, correct a fuel injection amount to cause the oxygen storage amount to coincide with a predetermined target value, and control the fuel injector to inject a corrected fuel injection amount.

The microprocessor is further programmed to determine if an output signal of the second oxygen sensor is fluctuating periodically between a stoichiometric region and a specific region outside the stoichiometric region. Herein, the stoichiometric region is defined as a region about the value corresponding to the stoichiometric air-fuel ratio. The microprocessor is further programmed to accumulate, when the output signal of the second oxygen sensor is fluctuating periodically between the stoichiometric region and the specific region, an excess/deficiency oxygen amount of exhaust gas flowing into the converter based on the output signal of the first oxygen sensor, and correct the output signal of the first oxygen sensor based on an accumulated excess/deficiency oxygen amount.

The details as well as other features and advantages of this invention are set forth in the remainder of the specification and are shown in the accompanying drawings.

DESCRIPTION OF THE PREFERRED EMBODIMENTS

Figure 1:
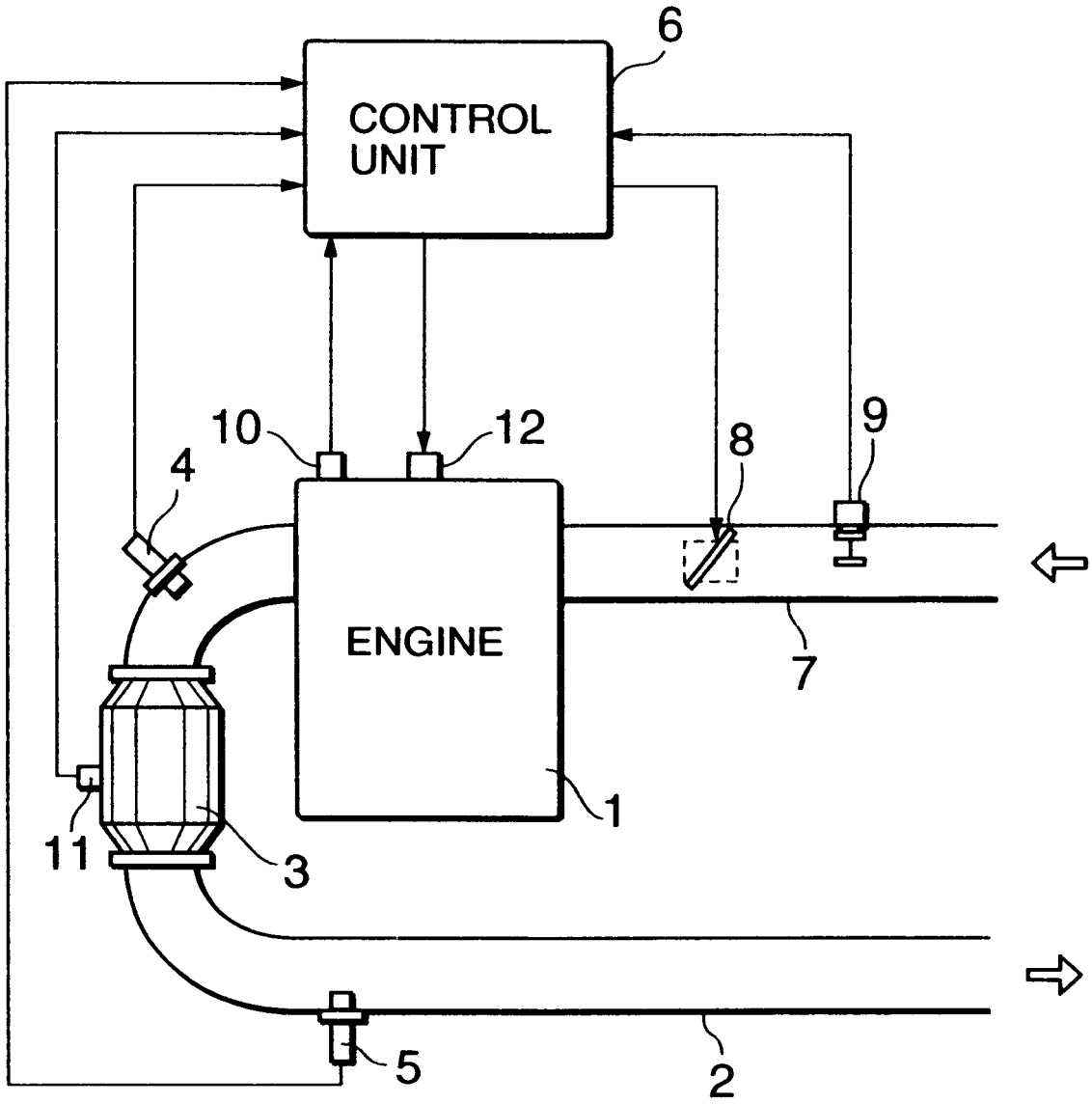
FIG. 1 is a schematic diagram of the structure of an air-fuel ratio controller for an engine according to this invention.

Referring to FIG. 1 of the drawings, a catalytic converter 3 is provided midway along an exhaust passage 2 of an automobile engine 1. In the exhaust passage 2, a universal exhaust gas oxygen sensor 4 is provided upstream of the catalytic converter 3 and an oxygen sensor 5 is provided downstream of the catalytic converter 3.

A control unit 6 controls an air-fuel ratio of the fuel mixture supplied to the engine 1 based on the output of these sensors.

A throttle valve 8 which regulates an aspirated air amount of the engine 1 is provided in an intake passage 7 of the engine 1.

A three-way catalyst is stored in the catalytic converter 3. The three-way catalyst displays maximum conversion efficiency of NOx, HC and CO when the gaseous environment of the catalyst has a stoichiometric oxygen concentration.

A stoichiometric oxygen concentration is the oxygen concentration of exhaust gas produced by the combustion of the fuel mixture of stoichiometric air-fuel ratio in the engine. When the fuel mixture is lean, the oxygen concentration of the exhaust gas will be higher than the stoichiometric oxygen concentration. When the fuel mixture is rich, the oxygen concentration of the exhaust gas will be lower than the stoichiometric oxygen concentration. In the following description, use of the term "lean" with respect to an output signal of the universal exhaust gas oxygen sensor 4 and the oxygen sensor 5 means that the oxygen concentration of exhaust gas is higher than the stoichiometric oxygen concentration. Conversely use of the term "rich" means that the oxygen concentration of exhaust gas is lower than the stoichiometric oxygen concentration.

The three-way catalyst has a coating of a precious metal such as platinum on a substrate. An oxygen storing material such as cerium is also coated onto the substrate and allows oxygen to be stored and released in response to an oxygen concentration of the exhaust gas from the engine 1.

The universal exhaust gas oxygen sensor 4 provided upstream of the converter 3 is a sensor which outputs a voltage signal proportional to the oxygen concentration of the exhaust gas. The oxygen sensor 5 which is provided downstream of the converter 3 is a common oxygen sensor using zirconia or titania.

Converse to the universal exhaust gas oxygen sensor 4, the oxygen sensor 5 outputs a high voltage signal when the oxygen concentration is lower than the stoichiometric oxygen concentration and outputs a low voltage signal when the oxygen concentration is higher than the stoichiometric oxygen concentration. It also has the tendency of rapidly varying the voltage signal about the stoichiometric oxygen concentration.

A airflow meter sensor 9 which measures an intake air amount regulated by the throttle valve 8 is provided in the intake passage 7 of the engine 1. A temperature sensor 10 which detects the temperature of engine cooling water is mounted in the engine 1 in order to determine the operational condition of the engine 1. A temperature sensor 11 is mounted in the catalytic converter 3 in order to detect the temperature TCAT of the three-way catalyst.

The output signals of the sensors 4, 5, 9, 10, 11 are input into the control unit 6. The control unit 6 comprises a microcomputer provided with a central processing unit (CPU), a read-only memory (ROM), a random access memory (RAM) and an input/output interface (I/O interface).

The control unit 6 calculates an oxygen storage amount of the three-way catalyst of the catalytic converter 3 based on output signals from the airflow meter sensor 9 and the universal exhaust gas oxygen sensor 4. The air-fuel ratio is feedback controlled so that the oxygen storage amount coincides with a target value. The air-fuel ratio is controlled by increasing or decreasing the fuel injection amount of a fuel injector 12 which is provided in the engine 1.

When the oxygen storage amount is less than a target value during control, the control unit 6 increases the oxygen storage amount of the catalyst by decreasing the fuel injection amount to make the air-fuel ratio of the fuel mixture lean. Conversely, when the oxygen storage amount is higher than a target value, the control unit 6 increases the oxygen release amount of the catalyst by increasing the fuel injection amount to make the air-fuel ratio of the fuel mixture rich.

The oxygen storage amount of the three-way catalyst is calculated as follows. It is possible to calculate an oxygen excess ratio with respect to the stoichiometric oxygen concentration in the exhaust gas from the oxygen concentration of exhaust gas upstream of the catalyst detected by the universal exhaust gas oxygen sensor 4. When the stoichiometric oxygen concentration is taken to have a value of zero, an oxygen excess ratio has a positive value when there is excess oxygen and has a negative value when there is a deficiency of oxygen.

An oxygen amount absorbed by the three-way catalyst in unit time or an oxygen amount released by the three-way catalyst in unit time may be calculated from the oxygen excess ratio and the intake air amount.

When the output signal of the oxygen sensor 5 provided downstream of the catalytic converter 3 has a low voltage, the oxygen storage amount of the three-way catalyst is reaching saturation or a maximum value. When the oxygen storage amount reaches saturation, the three-way catalyst can not store further oxygen and the excess amount of oxygen is discharged from the catalytic converter 3.

In this state, once the oxygen concentration of exhaust gas discharged from the engine 1 becomes lower than the stoichiometric oxygen concentration, the oxygen storage amount of the three-way catalyst begins to decrease from the maximum value.

On the other hand, when the output signal of the oxygen sensor 5 has a high voltage, the oxygen storage amount of the three-way catalyst is zero. When the oxygen storage amount is zero, the three-way catalyst can not release oxygen and exhaust gas with a low oxygen concentration is released from the converter 3.

In this state, once the oxygen concentration of exhaust gas discharged from the engine 1 becomes higher than the stoichiometric oxygen concentration, the oxygen storage amount of the three-way catalyst begins to increase from zero.

The increase or decrease ratio of the oxygen storage amount during the above process varies with respect to the oxygen excess ratio of the exhaust gas.

Thus when a certain operational condition is satisfied, it is possible to calculate the oxygen storage amount of the three-way catalyst in unit time based on the oxygen excess ratio. When these values are totaled, it is possible to calculate a current oxygen storage amount of the catalyst.

Providing that the oxygen storage capacity of the three-way catalyst has been determined on the basis of experiment, the oxygen storage/release function of the catalyst is optimized by setting, for example, a target oxygen storage amount at one half of the oxygen storage capacity. The control unit 6 controls the air-fuel ratio of the fuel mixture supplied to the engine 1 so that the oxygen storage amount of the three-way catalyst calculated during the above process coincides with the target value. This control routine allows the gaseous environment of the three-way catalyst to be maintained in a stable manner at the stoichiometric oxygen concentration.

Feedback control of the air-fuel ratio of the fuel mixture to coincide with the stoichiometric air-fuel ratio is known in the art as lambda control.

The control unit 6 satisfies the combustion characteristics required by the engine in response to operational conditions and controls the oxygen storage amount to the target amount by introducing a correction based on the deviation of the current oxygen storage amount of the three-way catalyst from the target amount into lambda control.

In addition to air-fuel ratio control as described above, the control unit 6 determines whether or not the output signal of the universal exhaust gas oxygen sensor 4 is normal. Even when the output signal has shifted to a lean or rich value, deviation of the oxygen storage amount from the target value is still prevented by correcting the output of the universal exhaust gas oxygen sensor 4.

Since the oxygen storage amount of the three-way catalyst is normally controlled towards the target value, even when there is a certain degree of fluctuation in the oxygen concentration upstream of the catalyst, the oxygen concentration downstream of the catalyst is maintained to near the stoichiometric oxygen concentration due to the oxygen storage/release function of the three-way catalyst.

However when there is a deviation in the output signal of the universal exhaust gas oxygen sensor 4, the oxygen storage amount of the three-way catalyst does not coincide with the target amount. For example, when the output signal of the universal exhaust gas oxygen sensor 4 shows an oxygen concentration which is lower than the actual oxygen concentration, the control unit 6 corrects the air-fuel ratio of the fuel mixture towards a lean value. When this condition continues, the oxygen storage amount of the three-way catalyst 6 will reach saturation.

Thus the oxygen concentration downstream of the catalytic converter 3 will fluctuate periodically between the stoichiometric oxygen concentration and the excess oxygen concentration. The control unit 6 determines that the output signal of the universal exhaust gas oxygen sensor 4 is deviating towards a low oxygen concentration on the basis of this phenomenon and performs a correction to regard the output voltage value of the universal exhaust gas oxygen sensor 4 as higher than the output voltage. A deviation is determined on the basis of a similar process to the above, when the output signal of the universal exhaust gas oxygen sensor 4 shows a higher oxygen concentration than the actual oxygen concentration, and a correction is performed to regard the output voltage value of the universal exhaust gas oxygen sensor 4 as lower than the output voltage.

Figure 2A:
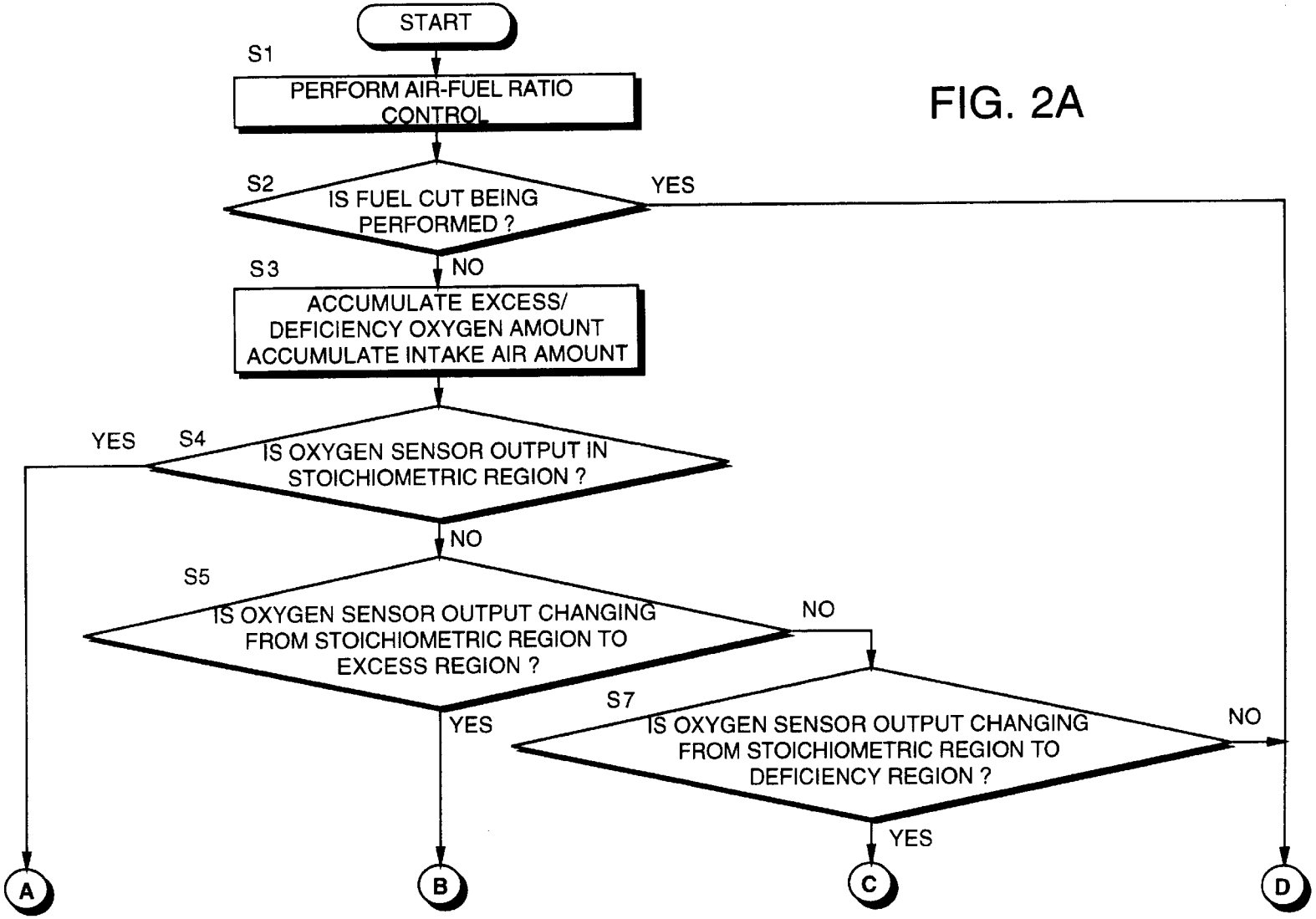
FIGS. 2A and 2B are flowcharts showing an output correcting routine for a universal exhaust gas oxygen sensor executed by a control unit according to this invention.
Figure 2B:
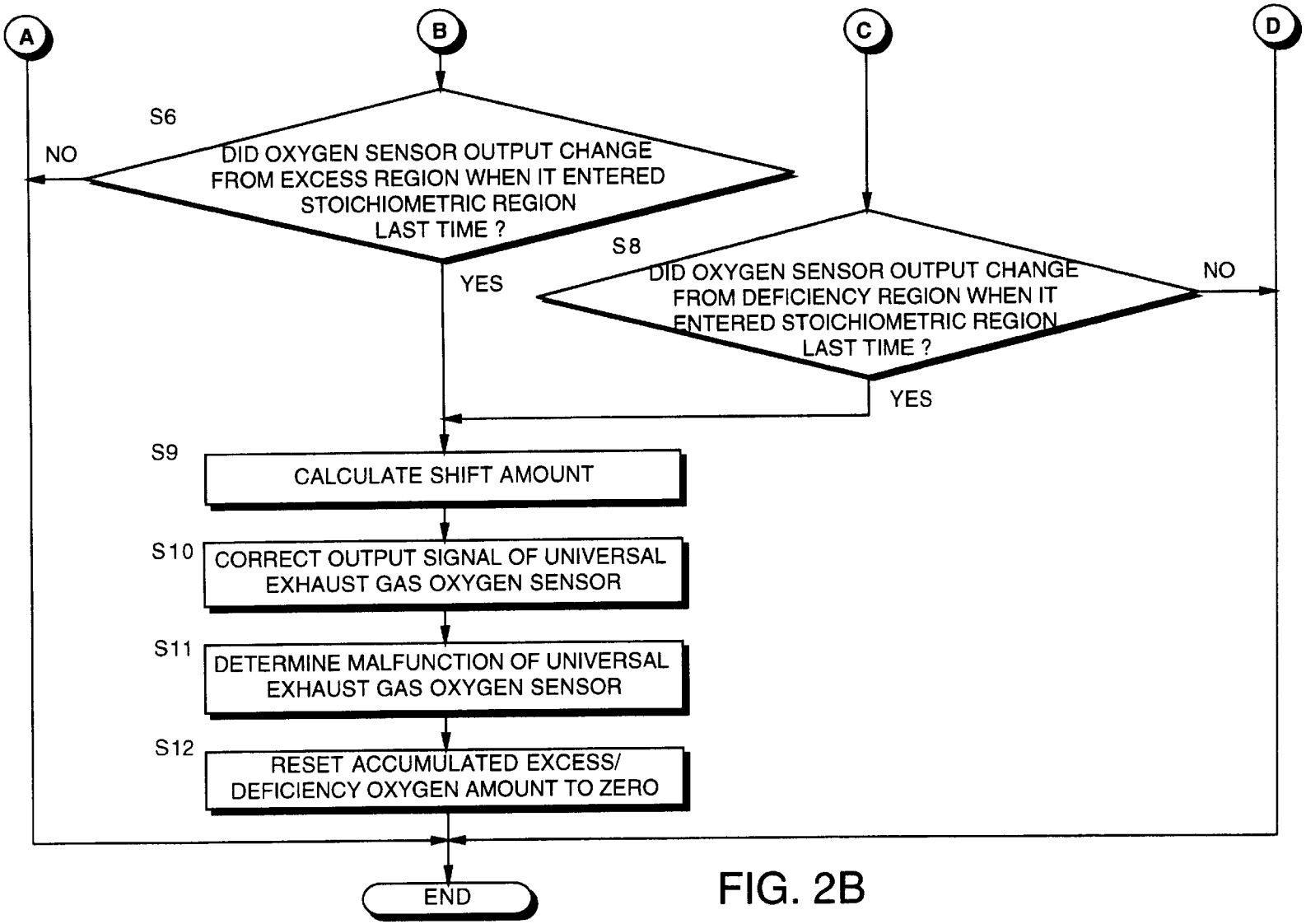

Referring now to FIGS. 2A and 2B, the output correction routine of the universal exhaust gas oxygen sensor 4 executed by the control unit 6 will be described. This routine is executed at an interval of 10 milliseconds for example.

In a step S1, the control unit 6 controls the air-fuel ratio of the fuel mixture supplied to the engine 1 by the method described above based on the output signal of the universal exhaust gas oxygen sensor 4 so that the oxygen storage amount of the three-way catalyst coincides with the target value. That is to say, a target air-fuel ratio is determined in response to the deviation of the current oxygen storage amount of the three-way catalyst from the target value and the fuel injection amount of the engine 1 is controlled based on the target air-fuel ratio.

Then in a step S2, it is determined whether fuel cut off is being performed.

When fuel cut off is being performed, the routine is immediately terminated.

When fuel cut off is not being performed, the routine proceeds to a step S3 and an excess/deficiency oxygen amount of the exhaust gas is accumulated up based on the output signal of the universal exhaust gas oxygen sensor 4 by the following method.

Firstly, an oxygen excess ratio of exhaust gas is calculated based on the output signal of the universal exhaust gas oxygen sensor 4. An excess/deficiency oxygen amount in unit time is calculated from the oxygen excess ratio, the intake air amount and the oxygen partial pressure in the atmosphere. Unit time may be set equal to the execution interval of the routine. The partial pressure of oxygen in the atmosphere is a fixed value. Thus, it is not required to measure the partial pressure. On the other hand, even when the oxygen excess ratio is the same, the excess/deficiency oxygen amount will vary according to the variation of the intake air amount. The excess/deficiency oxygen amount in unit time thus calculated is then accumulated at each occasion when the routine is executed.

In the step S3, the intake air amounts in unit time are also accumulated. Unit time here is also taken to be the execution interval of the routine.

Next in a step S4, it is determined whether or not the output signal of the oxygen sensor 5 is in the stoichiometric oxygen concentration region. The stoichiometric oxygen concentration region is the region between an upper limiting value and a lower limiting value set about the stoichiometric oxygen concentration. When the output signal of the oxygen sensor 5 is in the stoichiometric oxygen concentration region, it is understood that the oxygen storage or release amount of the three-way catalyst has not reached a limit. In other words, the stoichiometric oxygen concentration region is the region of fluctuations in the oxygen concentration in a range where the oxygen storage/release function of the three-way catalyst is functioning. In the following description, a region where the oxygen concentration is higher than the stoichiometric oxygen concentration region is referred to as an excess region, and a region where the oxygen concentration is lower than the stoichiometric oxygen concentration region is referred to as a deficiency region.

In the step S4, when the output signal of the oxygen sensor 5 is in the stoichiometric oxygen concentration region, the routine is immediately terminated without proceeding to other steps.

On the other hand, when the output signal of the oxygen sensor 5 is outside the stoichiometric oxygen concentration region, in the steps S5–S8, the routine determines in what manner the output signal of the oxygen sensor 5 is varying.

Firstly in the step S5, it is determined whether or not the output signal of the oxygen sensor 5 is rising from the stoichiometric oxygen concentration region to the excess region. When the output signal is rising from the stoichiometric oxygen concentration region to the excess region, the routine determines in the step S6 whether or not the output signal of the oxygen sensor 5 has entered from the excess region on the previous occasion when the signal entered the stoichiometric oxygen concentration region.

When the result of the determination is affirmative, it is understood that the oxygen concentration of the exhaust gas flowing out from the catalytic converter 3 is varying in the sequence of the excess region, stoichiometric oxygen concentration region, excess region.

During lambda control, the output signal of the oxygen sensor 5 should vary about the stoichiometric oxygen concentration region. When the output signal tends to deviate from the stoichiometric oxygen concentration region to only one of the excess region or the deficiency region, it is understood that the oxygen concentration detected by the universal exhaust gas oxygen sensor 4 is deviating from the actual value.

Thus when both of the determinations in the step S5 or the step S6 are affirmative, it is determined the universal exhaust gas oxygen sensor 4 has the tendency to detect an excessively large oxygen concentration.

When the determination in the step S5 is negative, it is determined in the step S7 that the output signal of the oxygen sensor 5 has decreased from the stoichiometric oxygen concentration to the deficiency region. When the determination result is affirmative, the routine proceeds to the step S8 and determines whether or not the output signal of the oxygen sensor 5 has entered from the deficiency region on the previous occasion when the signal entered the stoichiometric oxygen concentration region.

When the result of this determination is affirmative, it means that the oxygen concentration of the exhaust gas flowing from the catalytic converter 3 varying in the sequence of deficiency region, stoichiometric oxygen concentration region and deficiency region. In this case, it is determined the universal exhaust gas oxygen sensor 4 has the tendency to detect an excessively small oxygen concentration.

When the determination result in the step S6 or the step S8 is affirmative, that is to say, when the variation of the oxygen concentration in the exhaust gas flowing from the catalytic converter 3 displays either of the above sequences, the routine proceeds to a step S9.

When, on the contrary, the variation of the oxygen concentration in the exhaust gas flowing from the catalytic converter 3 displays neither of the above sequences, the routine is terminated without proceeding to further steps.

In the step S9, the amount of shift of the output signal of the universal exhaust gas oxygen sensor 4 is calculated.

For that purpose, an average oxygen excess ratio is calculated by dividing the excess/deficiency oxygen amount accumulated in the step S3 by the intake air amount accumulated in the step S3. The shift amount is then calculated by the following equation.

$$\text{Shift amount}=\{14.7/(1-\text{average oxygen excess ratio})\}-14.7$$

When the average oxygen excess ratio takes a positive value, the shift amount is positive, and when the average oxygen excess ratio takes a negative value, the shift amount is negative.

In a next step S10, the output signal of the universal exhaust gas oxygen sensor 4 is corrected by the calculated shift amount and stored in the memory so that the corrected output signal can be used during air-fuel ratio control, I.e., in the step S1 on the next occasion the routine is executed.

The absolute value of the average oxygen excess ratio increases as the deviation of the actual air-fuel ratio from the target air-fuel ratio increases. Thus the amount of shift based on the average oxygen excess ratio is a value displaying a close correspondence to the actual shift amount of the output signal of the universal exhaust gas oxygen sensor 4. Thus the correction allows the actual oxygen storage amount to converge to the target amount in a short time.

In a next step S11, it is determined whether or not the shift amount calculated in the step S9 is greater than a predetermined value.

The predetermined value is determined to for example a value with which the toxic components in the exhaust gas will be 1.5 times more than in the case where the shift amount is zero.

When the shift amount is greater than the predetermined value, it is determined that there is a malfunction in the universal exhaust gas oxygen sensor 4. A vehicle warning device is notified of the malfunction. When the absolute value of the shift amount reaches the predetermined value, it shows that the universal exhaust gas oxygen sensor 4 has deteriorated and stable air-fuel ratio control is difficult. In this case, since the deterioration can not be compensated for only by a correction, a warning is generated in order to indicate that the sensor 4 should be replaced. After the processing of the step S11, the routine proceeds to a step S12.

In the step S12, the excess/deficiency oxygen amount and the intake air amount respectively accumulated in the step S3 are both cleared and set to a value of zero and the routine is terminated.

In other words, these values are cleared to zero only when the output signal of the oxygen sensor 5 shows variation to the excess region from the stoichiometric region after there was variation from the excess region to the stoichiometric region, or when it shows variation to the deficiency region from the stoichiometric region after there was variation from the deficiency region to the stoichiometric region.

Referring now to FIGS. 3A–3D and FIGS. 4A–4D, the correction of the output signal of the universal exhaust gas oxygen sensor 4 by the above correction routine will be described.

The air fuel ratio of the fuel mixture supplied to the engine 1 is feedback controlled by the control unit 6 based on the oxygen concentration detected by the universal exhaust gas oxygen sensor 4. Thus the air-fuel ratio of the fuel mixture is controlled within a fixed range about the stoichiometric air-fuel ratio.

Under this control, the output signal of the oxygen sensor 5 downstream of the converter 3 stays in the stoichiometric oxygen concentration region by the action of the oxygen storage/release function of the three-way catalyst.

Figures 3A, 3B, 3C, 3D:
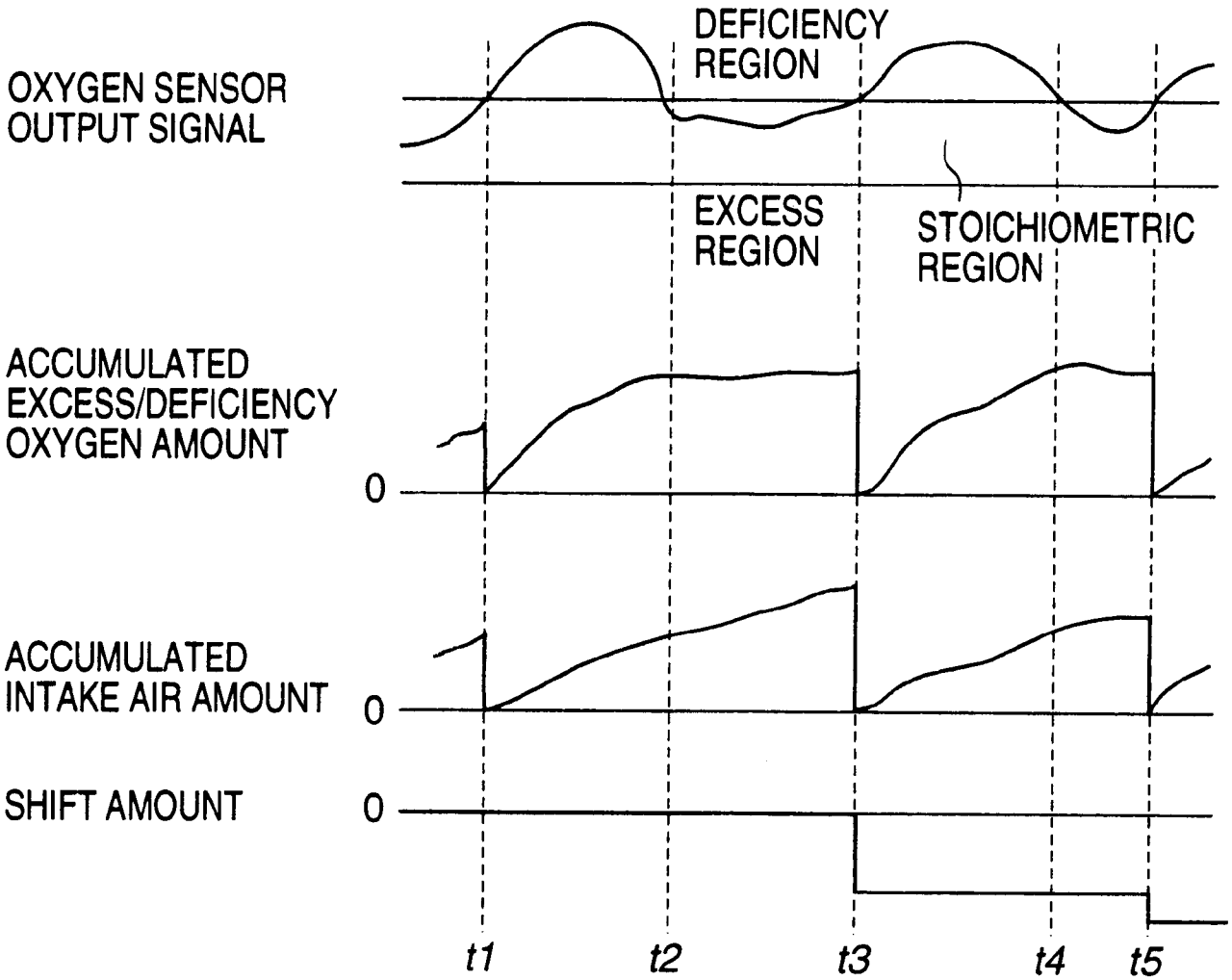
FIGS. 3A–3D are timing charts showing the output correction of the universal exhaust gas oxygen sensor according to this invention when an oxygen concentration downstream of the catalyst is low.

If the output signal of the universal exhaust gas oxygen sensor 4 deviates in a direction that the output signal shows an excessive oxygen concentration due to deterioration of the sensor or due to manufacturing errors, the control unit 6 determines that the air-fuel ratio of the fuel mixture is excessively lean and controls the air-fuel ratio of the fuel mixture supplied to the engine 1 towards rich accordingly. Therefore the actual air-fuel ratio is enriched, and the three-way catalyst releases the stored oxygen to compensate the enriched gaseous environment. However, the oxygen release function of the catalyst has its limit and when the release amount reaches the limit, the output signal of the oxygen sensor 5 varies to the deficiency region as shown in FIG. 3A. This is taken to be a time t1. The control unit 6 starts the accumulation of the excess/deficiency oxygen amount and the accumulation of the intake air amount by the execution of the routine of FIGS. 2A and 2B after the activation of the catalyst after the engine start-up. After the time t1, the output signal of the oxygen sensor 5 stays in the deficiency region until a time t2. In this region, since the determinations in the step S5 and step S7 are both negative when the routine is executed, the excess/deficiency oxygen amount and the intake air amount continue to be accumulated.

At the time t2, the output signal of the oxygen sensor 5 re-enters the stoichiometric oxygen concentration region from the deficiency region, but the accumulation of the excess/deficiency oxygen amount and the intake air amount continues as a result of the determination in the step S4 being affirmative. As a result, the accumulated intake air amount increases, but the accumulated excess/deficiency oxygen amount does not vary largely because the gaseous environment of the catalyst is in the stoichiometric oxygen concentration region. At a time t3, the output signal of the oxygen sensor 5 re-enters the deficiency region from the stoichiometric oxygen concentration region, and the determination result of both the step S7 and the step S8 in the flowchart becomes affirmative. As a result, a shift amount is calculated in the step S9 as an average oxygen concentration ratio calculated from the accumulated values. Thus as shown in FIG. 3D, the correction of the output signal of the universal exhaust gas oxygen sensor 4 is executed on the basis of the shift amount. At the same time, the accumulated excess/deficiency oxygen amount and the accumulated intake air amount are respectively reset to zero in the step S12, and the accumulation of the excess/deficiency oxygen amount and the intake air amount is resumed on the next occasion when the routine is performed.

At a time t4, when the output signal of the oxygen sensor 5 returns again to the stoichiometric oxygen concentration region, but the accumulation of the excess/deficiency oxygen amount and the intake air amount continues as in the case of time t2. When the output signal of the oxygen sensor 5 re-enters the deficiency region at a time t5, the determination result of both the step S7 and the step S8 in the flowchart becomes affirmative, and a correction of the output signal of the universal exhaust gas oxygen sensor 4 is again performed as shown in FIG. 3D using the shift amount re-calculated based on the accumulated values. In this way, the correction of the output signal the universal exhaust gas oxygen sensor 4 is performed until the output signal of the oxygen sensor 5 converges in the stoichiometric oxygen concentration region.

Figures 4A, 4B, 4C, 4D:
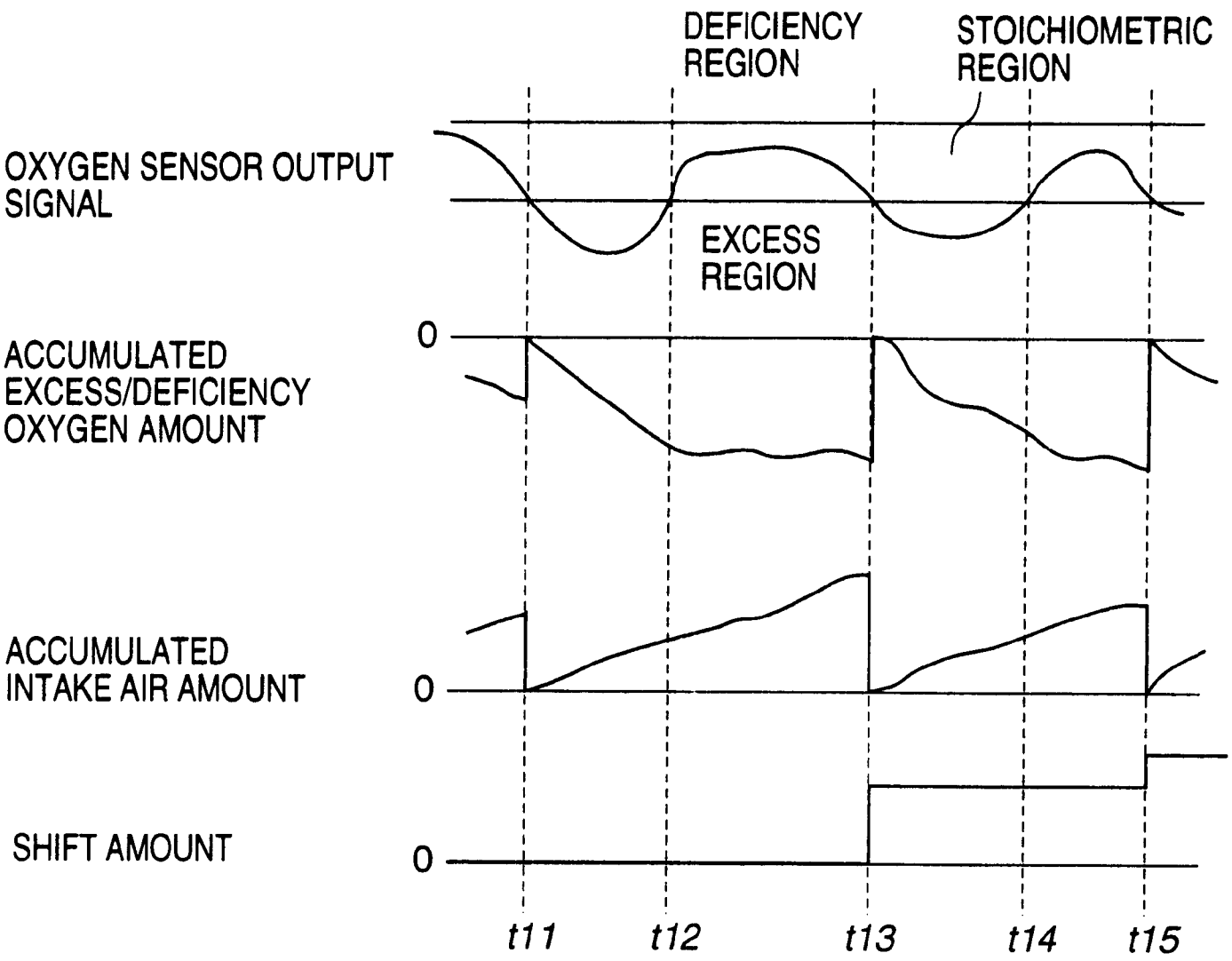
FIGS. 4A–4D are similar to FIGS. 3A–3D, but showing the output correction when the oxygen concentration downstream of the catalyst is high.

When, on the other hand, the output signal of the universal exhaust gas oxygen sensor 4 deviates in a direction that the output signal shows a deficient oxygen concentration due to deterioration of the sensor or due to manufacturing errors, the control unit 6 determines that the air-fuel ratio of the fuel mixture is excessively rich and controls the air-fuel ratio towards lean accordingly. Therefore, the actual air-fuel ratio is varied to lean values, and the three-way catalyst stores oxygen to compensate the lean gaseous environment. However, the oxygen storage function of the catalyst has its limit and when the oxygen storage amount reaches the limit, the output signal of the oxygen sensor 5 varies to the excess region as shown in FIG. 4A. This is taken to be a time t11. In this case also, the control unit 6 starts the accumulation of the excess/deficiency oxygen amount and the accumulation of the intake air amount by the execution of the routine of FIGS. 2A and 2B after the activation of the catalyst after the engine start-up. After the time t11, the output signal of the oxygen sensor 5 stays in the excess region until a time t12. In this region, since the determinations in the step S5 and step S7 are both negative when the routine is executed, the excess/deficiency oxygen amount and the intake air amount continue to be accumulated.

At the time tl2, the output signal of the oxygen sensor 5 re-enters the stoichiometric oxygen concentration region from the excess region, but the accumulation of the excess/deficiency oxygen amount and the intake air amount continues as a result of the determination in the step S4 being affirmative. As a result, the accumulated intake air amount increases, but the accumulated excess/deficiency oxygen amount does not vary largely because the gaseous environment of the catalyst is in the stoichiometric oxygen concentration region. At a time t13, when the output signal of the oxygen sensor 5 re-enters the excess region from the stoichiometric oxygen concentration region, and the determination result of both the step S5 and the step S6 in the flowchart becomes affirmative. As a result, a shift amount is calculated in the step S9 as an average oxygen concentration ratio calculated from the accumulated values. Thus as shown in FIG. 4D, the correction of the output signal of the universal exhaust gas oxygen sensor 4 is executed on the basis of the shift amount. At the same time, the accumulated excess/deficiency oxygen amount and the accumulated intake air amount are respectively reset to zero in the step S12, and the accumulation of the excess/deficiency oxygen amount and the intake air amount is resumed on the next occasion when the routine is performed. At a time t14, the output signal of the oxygen sensor 5 returns again to the stoichiometric oxygen concentration region, but the accumulation of the excess/deficiency oxygen amount and the intake air amount continues as in the case of time t12. When the output signal of the oxygen sensor 5 re-enters the excess region at a time t15, the determination result of both the step S5 and the step S6 in the flowchart becomes affirmative, and a re-correction of the output signal of the universal exhaust gas oxygen sensor 4 is again performed as shown in FIG. 4D using the shift amount re-calculated based on the accumulated values. In this way, the correction of the output signal the universal exhaust gas oxygen sensor 4 is performed until the output signal of the oxygen sensor 5 converges in the stoichiometric oxygen concentration region.

The absolute value of the average oxygen excess ratio increases as the shift amount of the output signal of the universal oxygen sensor 4 increases. Thus the output signal of the universal oxygen sensor 4 converges to a suitable value in a short time by correcting the output signal of the universal oxygen sensor 4 in response to the average oxygen excess ratio. Since the control unit 6 calculates the excess/deficiency oxygen amount based on the corrected output signal of the universal exhaust gas oxygen sensor 4 and performs feedback control of the air-fuel ratio such that the oxygen storage amount of the three-way catalyst coincides with the target value, the gaseous environment of the catalyst is precisely controlled and the performance of the catalyst is maximized.

Next, the calculation of the oxygen storage amount of the three-way catalyst executed by the control unit 6 in order to control the oxygen storage amount of the three-way catalyst will be described.

Oxygen storage by the three-way catalyst may be classified into oxygen adsorbed rapidly by the precious metal coated onto the substrate and oxygen which is absorbed slowly by an oxygen storage material such as cerium which is also coated onto the substrate. Thus when calculating the oxygen storage amount of the three-way catalyst, it is possible to increase the accuracy of the calculation by separately calculating the storage amount due to these two types of oxygen storage.

Figure 5:
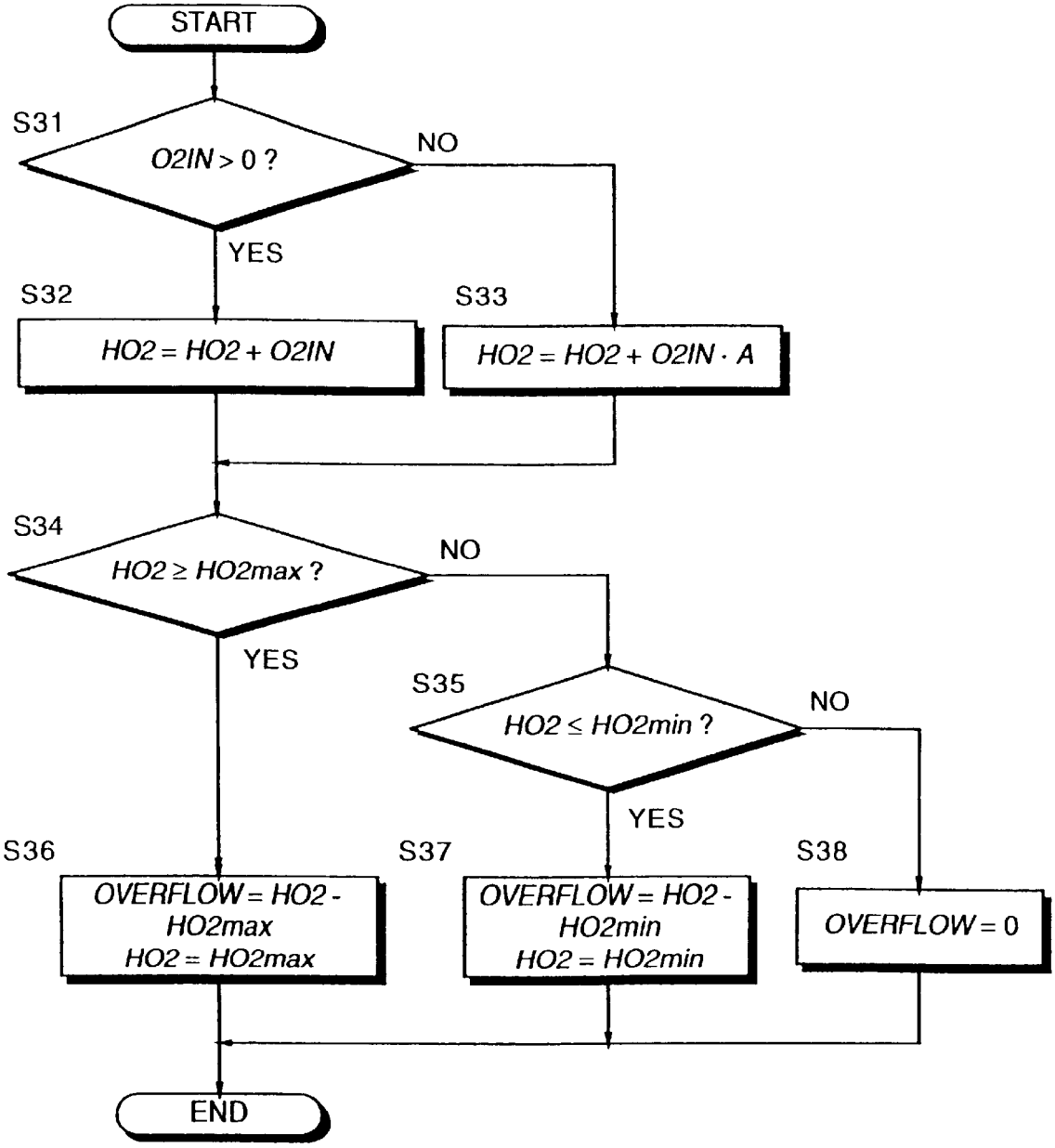
FIG. 5 is a flowchart showing a calculating routine executed by the control unit on a fast component of the oxygen storage amount.
Figure 6:
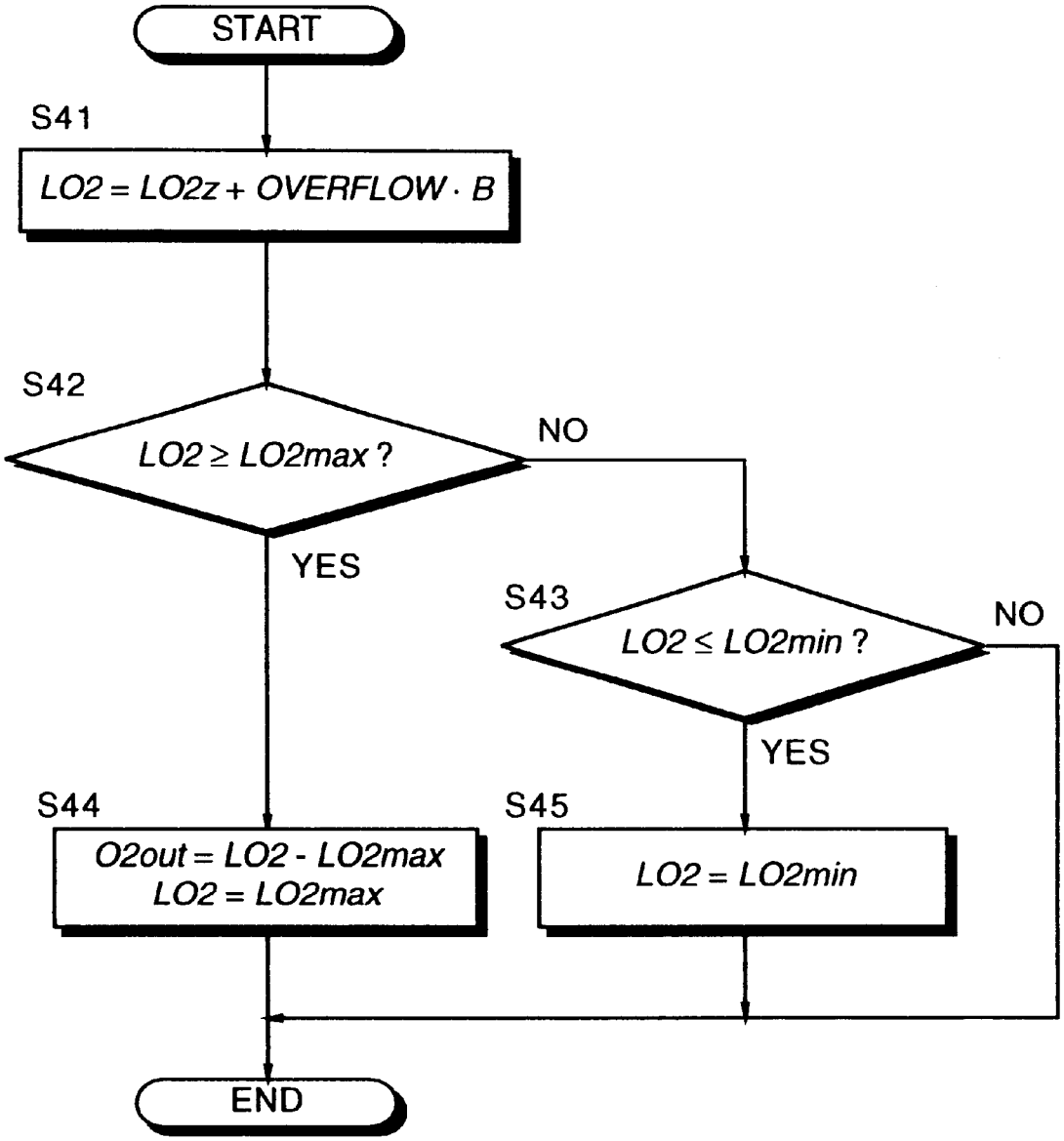
FIG. 6 is a flowchart showing a calculating routine executed by the control unit on a slow component of the oxygen storage amount.

Referring now to FIG. 5 and FIG. 6, the calculating routine executed by the control unit 6 will be described.

FIG. 5 shows a calculating routine for the oxygen storage amount HO2 by the precious metal in the catalyst and FIG.

6 shows a calculating routine for the oxygen storage amount LO2 by the oxygen storage material. Both routines are executed for example at an interval of 10 milliseconds.

In the routine shown in FIG. 5, an oxygen storage amount HO2 by the precious metal is calculated based on an oxygen release ratio A of the precious metal and a unit excess/deficiency oxygen amount O2IN of the exhaust gas flowing into the catalytic converter 3. The unit excess/deficiency oxygen amount O2IN is the excess/deficiency oxygen amount during the routine execution interval that was calculated in the step S3 in FIG. 2A. The precious metal adsorbs all excess oxygen in the range of the oxygen storage capacity in an excess oxygen environment. On the other hand, release of oxygen in an oxygen deficiency environment is only possible at ratios lower than those during storage. The oxygen release ratio A is the ratio of the oxygen storage ratio and the oxygen release ratio of the precious metal. The oxygen release ratio A is therefore a positive value not larger than one.

Firstly in a step S31, it is determined from the unit excess/deficiency oxygen amount O2IN whether the current catalyst gaseous environment is in a storing condition or releasing condition. When the unit excess/deficiency oxygen amount O2IN is greater than zero, the gaseous environment is in a storing condition in which the catalyst is storing oxygen. When the unit excess/deficiency oxygen amount O2IN is smaller than zero, the gaseous environment is in a releasing condition in which the catalyst is releasing oxygen.

When the unit excess/deficiency oxygen amount O2IN is greater than zero, the routine proceeds to a step S32 and the oxygen storage amount HO2 of the precious metal is calculated from Equation (1).

$$HO2=HO2z+O2IN \quad (1)$$

Where, HO2z is the oxygen storage amount of the precious metal calculated on the previous occasion when the routine is executed.

When the unit excess/deficiency oxygen amount O2IN is not larger zero, the routine proceeds to a step S33 and the oxygen storage amount HO2 of the precious metal is calculated from Equation (2).

$$HO2=HO2z+O2IN\cdot A \quad (2)$$

Where, A is oxygen release ratio of the precious metal.

Next, in the step S34, it is determined whether or not the calculated oxygen storage amount HO2 of the precious metal is greater than or equal to an allowable maximum value HO2max. When the oxygen storage amount HO2 exceeds the allowable maximum value HO2max, an excess amount OVERFLOW which exceeds the allowable maximum value HO2max is generated. In this case, in a step S36, the oxygen storage amount HO2 of the precious metal is set to equal the allowable maximum value HO2max and the routine is terminated after calculating the excess amount OVERFLOW by Equation (3).

$$OVERFLOW=HO2-HO2max \quad (3)$$

In the step S34, when the oxygen storage amount of the precious metal does not exceed the allowable maximum value HO2max, the routine proceeds to a step S35 and it is determined whether or not the oxygen storage amount HO2 of the precious metal is larger than an allowable minimum value HO2min. When the oxygen storage amount HO2 is not larger than the allowable minimum value HO2min, it shows that substantially all of the stored oxygen in the precious metal has been released and the excess/deficiency oxygen amount O2IN has a negative value. That is to say, the gaseous environment of the catalyst has an oxygen deficiency. In this case, in a step S37, the oxygen storage amount HO2 is set equal to the allowable minimum value HO2min and the routine is terminated after calculating the deficiency of the release amount as a negative excess amount OVERFLOW from Equation (4).

$$OVERFLOW=HO2-HO2min \quad (4)$$

When the oxygen storage amount HO2 of the precious metal is between the allowable maximum value HO2max and the allowable minimum value HO2min, the unit excess/deficiency oxygen amount O2IN of exhaust gas flowing into the catalytic converter 3 is compensated by the oxygen storing or releasing function of the precious metal. In this case, in a step S38, the excess amount OVERFLOW is set to zero and the routine is completed.

The oxygen storage material stores or releases the excess amount OVERFLOW calculated by the above routine.

Referring now to FIG. 6, a calculating routine of the oxygen storage amount of the oxygen storage material will be described.

This routine uses the excess amount OVERFLOW calculated in the routine shown in FIG. 5.

Firstly in a step S41, an oxygen storage amount LO2 of the oxygen storage material is calculated from Equation (5).

$$LO2=LO2z+OVERFLOW\cdot B \quad (5)$$

Where,

LO2z=previous value for LO2, and

B=oxygen storage/release ratio of oxygen storage material.

The oxygen absorption/release ratio B of oxygen storage material expresses the oxygen storage ratio and the oxygen release ratio of the oxygen storage material when the oxygen storage ratio of the precious metal is taken to have a value of one. The oxygen storage/release ratio B is set to a positive value not larger than one. The oxygen storage ratio and the oxygen release ratio of the oxygen storage material are not strictly the same. Furthermore they vary due to the oxygen storage amount LO2 of the oxygen storage material or the catalyst temperature TCAT. Thus the oxygen storage ratio and the oxygen release ratio of the oxygen storage material may be set as a variable.

When the excess amount OVERFLOW is positive, oxygen in the catalyst gaseous environment is in excess. The oxygen storage/release ratio B of oxygen storage material at this time is set to a value which increases as, for example, the catalyst temperature TCAT increases or as the oxygen storage amount LO2 of the oxygen storage material decreases. On the other hand, when the excess amount OVERFLOW has a negative value, there is a deficiency of oxygen in the catalyst gaseous environment. Thus the oxygen storage/release ratio B of oxygen storage material at this time is set to a value which increases as, for example, the catalyst temperature TCAT increases or as the oxygen storage amount LO2 of the oxygen storage material increases.

That is to say, the oxygen storage amount LO2 of the oxygen storage material or the catalyst temperature TCAT influences the oxygen absorption ratio and the oxygen release ratio in the same manner. In this embodiment, this is the reason why the oxygen storage ratio and the oxygen release ratio are set to the same value B.

In a step S42, the calculated oxygen storage amount LO2 of the oxygen storage material is compared with an allowable maximum value LO2max. When the oxygen storage amount LO2 is greater than or equal to the allowable maximum value LO2max, the routine proceeds to a step S44. In the step S44, the oxygen storage amount LO2 is set equal to the allowable maximum value LO2max and a deficiency oxygen amount O2out is calculated from Equation (6) and the routine is terminated.

$$O2out=LO2-Lo2max \quad (6)$$

In the step S42, when the oxygen storage amount LO2 is less than the allowable maximum value LO2max, the calculated oxygen storage amount LO2of the oxygen storage material is compared with the allowable minimum value LO2min in a step S43. When the oxygen storage amount LO2 is less than the allowable minimum value LO2min, the routine proceeds to a step S45. In the step S45, the oxygen storage amount LO2 is set equal to the allowable minimum value LO2min and the routine is terminated. When the oxygen storage amount LO2 is greater than the allowable minimum value LO2min, the routine is terminated without proceeding to further steps.

Figure 7:
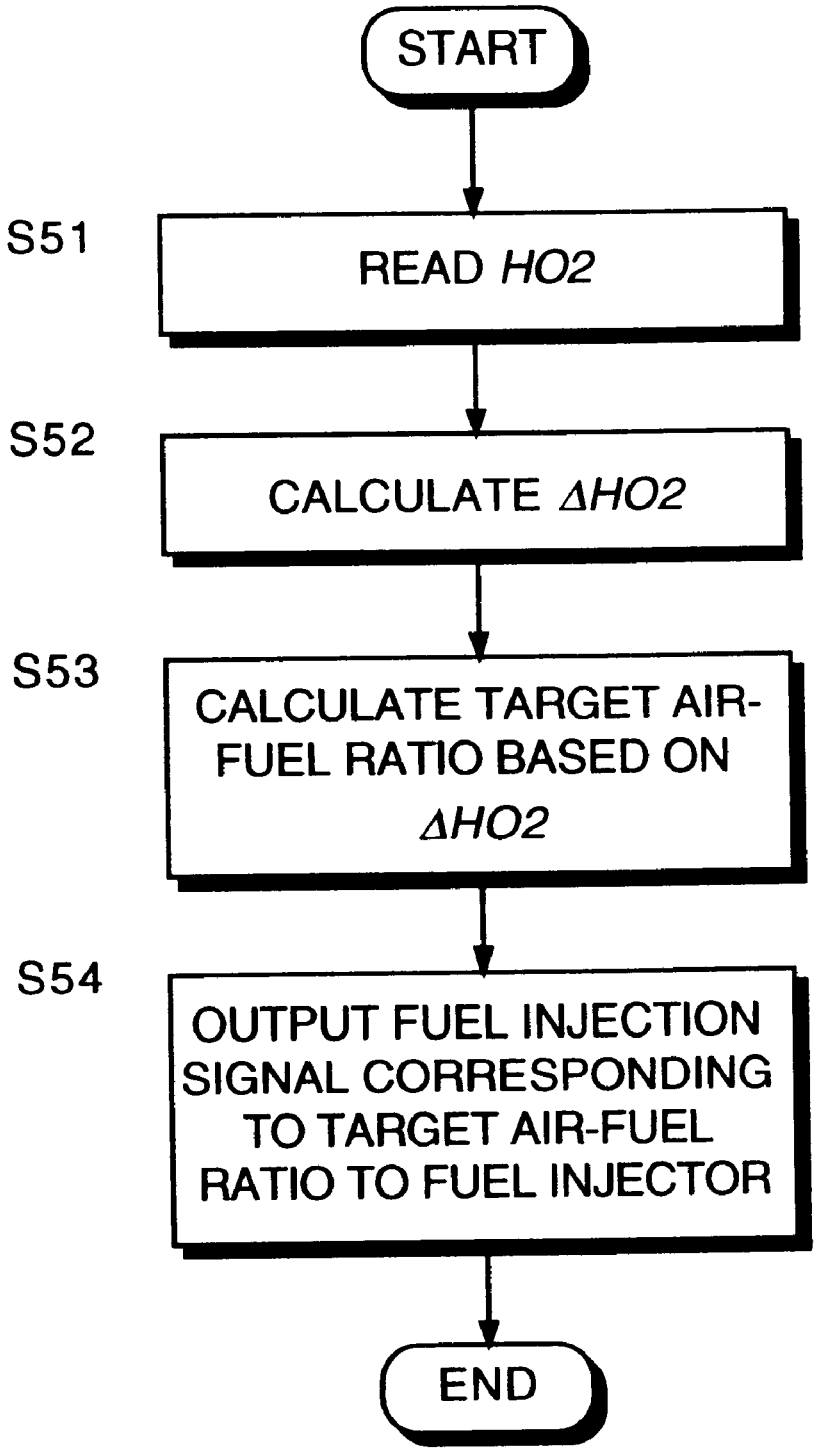
FIG. 7 is a flowchart showing an air-fuel ratio control routine performed by the control unit.

The control unit 6 performs air-fuel ratio control of the fuel mixture supplied to the engine 1 using the above calculated oxygen storage amount of the catalyst. FIG. 7 shows a routine for this air-fuel ratio control performed by the control unit 6. This routine corresponds to the process of step S1 in FIG. 2A.

In a step S51, the current oxygen storage amount HO2 of the precious metal that was calculated by the routine of FIG. 5 is read.

In a step S52, a deviation ΔHO2 between the current oxygen storage amount HO2 and a target value TGHO2 is computed. The target value TGHO2 of the oxygen storage amount of the precious metal is set to, for example, a half of the allowable maximum value HO2max.

In a step S53, the computed deviation ΔHO2 is converted to an air-fuel ratio equivalent value, and a target air-fuel ratio T-A/F of the engine 1 is set based on the air-fuel ratio equivalent value.

In a step S54, the control unit 6 outputs a fuel injection signal corresponding to the target air-fuel ratio T-A/F to the fuel injector 12.

According to this routine, when the oxygen storage amount HO2 of the precious metal does not reach a target amount, the target air-fuel ratio of the fuel mixture supplied to the engine 1 is set to lean so as to increase the oxygen storage amount. When the oxygen storage amount HO2 exceeds the target amount, the target air fuel-ratio of the fuel mixture is set to rich so as to decrease the oxygen storage amount. The fuel Injection amount of the fuel injector 12 is then determined based on the target air fuel-ratio.

It should be noted that only the oxygen storage amount HO2 of the precious metal is controlled by this routine. The reason why the oxygen storage amount LO2 of the oxygen storage material is not considered in the air-fuel ratio control is that the oxygen storage amount LO2 of the oxygen storage material is not responsive to such an air-fuel ratio control. However, according to the research by the inventors, the oxygen storage amount LO2 of the oxygen storage material affects the oxygen release ratio A applied for the calculation of the oxygen storage amount HO2 of the precious metal when it releases oxygen. It is therefore preferable to vary the value of the oxygen release ratio A depending on the oxygen storage amount LO2 of the oxygen storage material. The routine for calculating the oxygen storage amount LO2 of the oxygen storage material shown in FIG. 6 is performed for this purpose.

The contents of Tokugan 2000-46102, with a filing date of Feb. 23, 2000 in Japan, are hereby incorporated by reference.

Although the invention has been described above by reference to certain embodiments of the invention, the invention is not limited to the embodiments described above. Modifications and variations of the embodiments described above will occur to those skilled in the art, in light of the above teachings.

The embodiments of this invention in which an exclusive property or privilege is claimed are defined as follows:

What is claimed is:

1. An air-fuel ratio controller for an engine, the engine comprising an intake passage which intakes air into the engine, an exhaust passage, a catalytic converter disposed in the exhaust passage to purify exhaust gas, the catalytic converter accommodating a catalyst which stores oxygen when an oxygen concentration in exhaust gas is higher than a predetermined concentration and releases oxygen when the oxygen concentration in exhaust gas is lower than the predetermined concentration, and a fuel injector which supplies fuel to the engine, the controller comprising:

a first sensor means for detecting an oxygen concentration in the exhaust passage upstream of the catalytic converter and outputting a corresponding signal;

a second sensor means for detecting an oxygen concentration in the exhaust passage downstream of the catalytic converter and outputting a corresponding signal;

a third sensor means for detecting an intake air amount of the intake passage;

means for calculating a fuel injection amount of the fuel injector to cause an output signal of the first sensor means to coincide with a value corresponding to a stoichiometric air-fuel ratio;

means for calculating an oxygen storage amount of the catalyst based on the output signal of the first sensor means;

means for correcting a fuel injection amount to cause the oxygen storage amount to coincide with a predetermined target value;

means for controlling the fuel injector to inject a corrected fuel injection amount;

means for determining if an output signal of the second sensor means is fluctuating periodically between a stoichiometric region and a specific region outside the stoichiometric region, the stoichiometric region being defined as a region about the value corresponding to the stoichiometric air-fuel ratio;

means for calculating an excess ratio of oxygen in the exhaust gas in the exhaust passage upstream of the converter with respect to the value corresponding to the stoichiometric air-fuel ratio from the oxygen concentration detected by the first oxygen sensor;

means for calculating an excess/deficiency oxygen amount of exhaust gas flowing into the converter from the intake air amount and the excess ratio;

means for respectively accumulating the excess/deficiency oxygen amount and the intake air amount in the specific region when the output signal of the second sensor means is fluctuating periodically between the stoichiometric region and the specific region;

means for calculating an average oxygen excess ratio in the specific region by dividing an accumulated excess/deficiency oxygen amount by an accumulated intake air amount; and means for correcting the output signal of the first sensor means based on the average oxygen excess ratio.

2. A method for controlling air-fuel ratio of fuel mixture supplied to an engine, the engine comprising an intake passage which intakes air into the engine, an exhaust passage, a catalytic converter disposed in the exhaust passage to purify exhaust gas, the catalytic converter accommodating a catalyst which stores oxygen when an oxygen concentration in exhaust gas is higher than a predetermined concentration and releases oxygen when the oxygen concentration in exhaust gas is lower than the predetermined concentration, a fuel injector which supplies fuel to the engine, a first oxygen sensor which detects an oxygen concentration in the exhaust passage upstream of the catalytic converter and outputting a corresponding signal, a second oxygen sensor which detects an oxygen concentration in the exhaust passage downstream of the catalytic converter and outputting a corresponding signal, and a sensor which detects an intake air amount of the intake passage, the method comprising:

calculating a fuel injection amount of the fuel injector which makes the oxygen concentration in the exhaust passage upstream of the catalytic converter to coincide with a value corresponding to a stoichiometric air-fuel ratio based on an output signal of the first oxygen sensor;

calculating an oxygen storage amount of the catalyst based on the output signal of the first sensor;

correcting a fuel injection amount that makes the oxygen storage amount coincide with a predetermined target value;

controlling the fuel injector to inject a corrected fuel injection amount;

determining if the output of the second sensor is fluctuating periodically between a stoichiometric region and a specific region outside the stoichiometric region, the stoichiometric region being defined as a region about the value corresponding to the stoichiometric air-fuel ratio;

calculating an excess ratio of oxygen in the exhaust gas in the exhaust passage upstream of the converter with respect to the value corresponding to the stoichiometric air-fuel ratio from the oxygen concentration detected by the first oxygen sensor;

calculating an excess/deficiency oxygen amount of exhaust gas flowing into the converter from the intake air amount and the excess ratio;

respectively accumulating the excess/deficiency oxygen amount and the intake air amount in the specific region when the output signal of the second oxygen sensor is fluctuating periodically between the stoichiometric region and the specific region;

calculating an average oxygen excess ratio in the specific region by dividing an accumulated excess/deficiency oxygen amount by an accumulated intake air amount; and correcting the output signal of the first sensor based on the average oxygen excess ratio.

3. An air-fuel ratio controller for an engine, the engine comprising an intake passage which intakes air into the engine, an exhaust passage, a catalytic converter disposed in the exhaust passage to purify exhaust gas, the catalytic converter accommodating a catalyst which stores oxygen when an oxygen concentration in exhaust gas is higher than a predetermined concentration and releases oxygen when the oxygen concentration in exhaust gas is lower than the predetermined concentration, and a fuel injector which supplies fuel to the engine, the controller comprising:

a first oxygen sensor which detects an oxygen concentration in the exhaust passage upstream of the catalytic converter and outputting a corresponding signal;

a second oxygen sensor which detects an oxygen concentration in the exhaust passage downstream of the catalytic converter and outputting a corresponding signal;

a sensor which detects an intake air amount of the intake passage; and a microprocessor programmed to:

calculate a fuel injection amount of the fuel injector to cause an output signal of the first oxygen sensor to coincide with a value corresponding to a stoichiometric air-fuel ratio;

calculate an oxygen storage amount of the catalyst based on the output signal of the first oxygen sensor;

correct a fuel injection amount to cause the oxygen storage amount to coincide with a predetermined target value;

control the fuel injector to inject a corrected fuel injection amount;

determine if an output signal of the second oxygen sensor is fluctuating periodically between a stoichiometric region and a specific region outside the stoichiometric region, the stoichiometric region being defined as a region about the value corresponding to the stoichiometric air-fuel ratio;

calculate an excess ratio of oxygen in the exhaust gas in the exhaust passage upstream of the converter with respect to the value corresponding to the stoichiometric air-fuel ratio from the oxygen concentration detected by the first oxygen sensor;

calculate an excess/deficiency oxygen amount of exhaust gas flowing into the converter from the intake air amount and the excess ratio;

respectively accumulate the excess/deficiency oxygen amount and the intake air amount in the specific region when the output signal of the second oxygen sensor is fluctuating periodically between the stoichiometric region and the specific region;

calculate an average oxygen excess ratio in the specific region by dividing an accumulated excess/deficiency oxygen amount by an accumulated intake air amount; and correct the output signal of the first oxygen sensor based on the average oxygen excess ratio.

4. The air-fuel controller as defined in claim 1, wherein the microprocessor is further programmed to determine whether or not the engine is in a fuel-cut condition in which the fuel injector does not inject fuel, and prevent a correction of the output signal of the first oxygen sensor from being performed when the engine is in the fuel-cut condition.

5. The air-fuel controller as defined in claim 1, wherein the microprocessor is further programmed to determine that the first oxygen sensor is malfunctioning when an absolute value of a correction value of the output signal of the first oxygen sensor is greater than a predetermined value.

6. The air-fuel controller as defined in claim 1, wherein the first oxygen sensor comprises a universal exhaust gas oxygen sensor which outputs a voltage signal proportional to an oxygen concentration of exhaust gas.

7. An air-fuel ratio controller for an engine, the engine comprising an exhaust passage, a catalytic converter disposed in the exhaust passage to purify exhaust gas, the catalytic converter accommodating a catalyst which stores oxygen when an oxygen concentration in exhaust gas is higher than a predetermined concentration and releases oxygen when the oxygen concentration in exhaust gas is lower than the predetermined concentration, the catalyst comprising a precious metal which rapidly stores and releases oxygen and an oxygen storage material which slowly stores and releases oxygen, and a fuel injector which supplies fuel to the engine, the controller comprising:

a first oxygen sensor which detects an oxygen concentration in the exhaust passage upstream of the catalytic converter and outputting a corresponding signal;

a second oxygen sensor which detects an oxygen concentration in the exhaust passage downstream of the catalytic converter and outputting a corresponding signal; and a microprocessor programmed to:

calculate a fuel injection amount of the fuel injector to cause an output signal of the first oxygen sensor to coincide with a value corresponding to the stoichiometric air-fuel ratio;

calculate an oxygen storage amount of the catalyst by separately calculating an oxygen storage amount of the precious metal and an oxygen storage amount of the oxygen storage material based on an oxygen concentration detected by the first oxygen sensor;

correct a fuel injection amount to cause the oxygen storage amount of the catalyst to coincide with a predetermined target value;

control the fuel injector to inject a corrected fuel injection amount;

determine if an output signal of the second oxygen sensor is fluctuating periodically between a stoichiometric region and a specific region outside the stoichiometric region, the stoichiometric region being defined as a region about the value corresponding to the stoichiometric air-fuel ratio;

accumulate, when the output signal of the second oxygen sensor is fluctuating periodically between the stoichiometric region and the specific region, an excess/deficiency oxygen amount of exhaust gas flowing into the converter based on the output signal of the first oxygen sensor; and correct the output signal of the first oxygen sensor based on an accumulated excess/deficiency oxygen amount.

8. The air-fuel controller as defined in claim 7, wherein the microprocessor is further programmed to determine whether or not the engine is in a fuel-cut condition in which the fuel injector does not inject fuel, and prevent a correction of the output signal of the first oxygen sensor from being performed when the engine is in the fuel-cut condition.

9. The air-fuel controller as defined in claim 7, wherein the microprocessor is further programmed to determine that the first oxygen sensor is malfunctioning when an absolute value of a correction value of the output signal of the first oxygen sensor is greater than a predetermined value.

10. The air-fuel controller as defined in claim 7, wherein the first oxygen sensor comprises a universal exhaust gas oxygen sensor which outputs a voltage signal proportional to an oxygen concentration of exhaust gas.

* * * * *

UNITED STATES PATENT AND TRADEMARK OFFICE

CERTIFICATE OF CORRECTION

PATENT NO. : 6,446,429 B2
DATED : September 10, 2002
INVENTOR(S) : Hideaki Kobayashi et al.

It is certified that error appears in the above-identified patent and that said Letters Patent is hereby corrected as shown below:

Column 1,
Line 17, between “a” and “air-fuel”, please insert -- stoichiometric --.

Column 16,
Lines 43, 49 and 54, please delete “1” and insert -- 3 --.

Signed and Sealed this

Eighth Day of April, 2003

JAMES E. ROGAN
*Director of the United States Patent and Trademark Office*